United States Patent [19]

Nix et al.

[11] Patent Number: 4,772,229

[45] Date of Patent: Sep. 20, 1988

[54] PLUG CONNECTOR HAVING SEPARATE TERMINAL RETAINING MEMBER

[75] Inventors: Lothar H. W. Nix, Moerfelden-Walldorf; Heinrich R. Schmidt, Langen, both of Fed. Rep. of Germany

[73] Assignee: AMP Incorporated, Harrisburg, Pa.

[21] Appl. No.: 635,771

[22] Filed: Jul. 30, 1984

[51] Int. Cl.[4] ..... H01R 13/436

[52] U.S. Cl. ..... 439/733; 439/869

[58] Field of Search ..... 339/210 R, 210 M, 217 R; 439/733, 752, 869

[56] References Cited

U.S. PATENT DOCUMENTS

| | | | |
|---|---|---|---|
| 4,082,398 | 4/1978 | Bourdon et al. | 339/217 S |
| 4,319,799 | 3/1982 | Pearce, Jr. | 339/217 R |
| 4,433,888 | 2/1984 | Winger | 339/91 R |

*Primary Examiner*—Gil Weidenfeld
*Assistant Examiner*—Gary F. Paumen
*Attorney, Agent, or Firm*—Bruce J. Wolstoncroft

[57] ABSTRACT

Connector plug comprises a housing having main body part and a separate terminal retaining member which retains the terminals in the cavities of the housing. The terminal retaining member extends into a recess which is between the ends of the main body of the housing and has retaining ears that prevent movement of the terminals from the cavities. The retaining member is releasably latched to the main body part of the housing by a latch arm that is contained within the main body part. An access opening is provided in the main body part of the housing to permit disengagement of the latch arm and removal of the terminal retainer part from the main body part. The connector is sealed and is relatively compact.

11 Claims, 3 Drawing Sheets

PLUG CONNECTOR HAVING SEPARATE TERMINAL RETAINING MEMBER

FIELD OF THE INVENTION

This invention relates to electrical connector plugs of the type having a separate retaining member which is assembled to the housing for retaining the terminals in the contact-receiving cavities of the housing. The invention is particularly concerned with a connector plug which is relatively short or compact and which has a latching system for retaining or holding the retainer in the housing which latching system is within the main body part of the housing. The invention is further concerned with improved sealing means for connector plugs.

BACKGROUND OF THE INVENTION

A standard type of bulb holder for lamp bulbs of the type used in automotive head lamps comprises an insulating support in which the bulb is mounted having an integral hollow receptacle socket. The bulb holder is mounted in the reflector of the automotive vehicle and when the conductors are connected to the terminal tabs of the bulb, it is merely necessary to insert a suitably designed and dimensioned connector plug into the receptacle of the bulb holder.

While a wide variety of connector plugs might be designed which would serve the purpose of connecting the wires of the automotive harness to the terminals in the bulb holder, there are certain requirements for the plug receptacle which must be satisfied. For example, the connector plug should be as compact as reasonably possible for the reason that open space in the vicinity of the head lamps of a vehicle is limited and under many circumstances there is only limited clearance for the connector plug. Additionally, the connector plug should be sealed against the admission of moisture for the reason that it will be used in a hostile environment and if it is not sealed, the terminals may deteriorate rapidly. A further desirable feature for the connector plug is that it should be serviceable or repairable in the sense that is should be possible to remove one or more of the terminals from the connector for replacement or repair. At the same time, the retainers for retaining the terminals in the housing of the connector plug should provide a high degree of assurance that the connector will function throughout its life without failure and without accidental removal of the terminals from the plug housing. The present invention is directed to the achievement of a compact cylindrical connector having an improved contact retainer and improved sealing features which is particularly intended for use with a head lamp bulb holder of the type described above.

THE INVENTION

The invention comprises an electrical connector plug which is intended to be coupled to a complementary connector of the type comprising a hollow cylindrical receptacle having an open plug-receiving end, an inner end, and a plurality of terminals extending from the inner end parallel to the axis of the receptacle. A cylindrical receptacle of this general type is provided on a standard type of head lamp bulb holder which is now coming into widespread use. The connector plug of the present invention comprises a cylindrical housing having a mating end, a wire entry end, a plurality of terminal-receiving cavities extending through the housing, and a terminal retained in each of the cavities by a terminal retainer. The cylindrical housing has an external cylindrical surface which is substantially against the internal surface of the hollow cylindrical receptacle when the connector is inserted into the receptacle. The connector plug of the invention is characterized in that the cylindrical housing comprises a main body part and a terminal retainer part. The terminal-receiving cavities extend through the main body part and a retainer-receiving recess extends into the main body part and intersects the terminal-receiving cavities. The retainer part is inserted into the recess and has terminal-retaining ears which project into the terminal-receiving cavities. These ears prevent axial movement of the terminals in at least one direction and thereby retain the terminals in the cavities. The retainer part and the main body part have a releasable latching system for securing the retainer part in the body part and this latching system is contained within the housing and surrounded by the external cylindrical surface of the housing. An access opening is provided in the housing and extends to the latching system to permit access to the latching system so that the retainer part can be unlatched from the main body part and removed.

Further embodiments of the invention are characterized in that the retainer-receiving recess extends into the main body part at a location between the mating end and the wire entry end and the latching system comprises a flexible latch arm on one of the parts and a latching ear on the other part. The access opening preferably extends parallel to the axis of the main body part from the wire entry end thereof and the latch arm is in the preferred embodiment provided on the terminal retainer part of the housing.

THE DRAWING FIGURES

FIG. 3 is a sectional side view of the connector plug showing the retainer part as exploded from the retainer-receiving recess.

THE DISCLOSED EMBODIMENT

Figure 1:
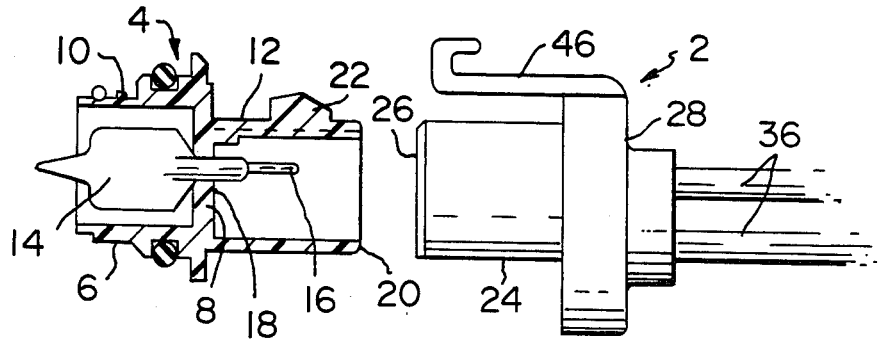
FIG. 1 is a side view showing a conventional bulb holder showing a connector plug in accordance with the present invention in alignment with the receptacle portion of the bulb holder.

A connector plug 2 in accordance with the present invention is intended to be coupled to the hollow cylindrical receptacle 12 of a head lamp bulb holder 4, see FIG. 1. The bulb holder 4 comprises an insulating housing 6 having a cylindrical forward portion 10 in which the bulb 14 is located, the previously identified receptacle portion 12 and a common wall 8 between the two cylindrical portions. The tabs 16 and the base of the bulb 14 extend through the wall 8 and from the inner wall 18 of the receptacle 12. The receptacle has an open outer end or mating end 20 and has a latching ear 22 on its surface which cooperates with a latch arm 46 on the plug as described below. Bulb holders of the type shown in FIG. 1 are intended to be mounted in the reflector of a head lamp at a precisely predetermined location and the conductors of the automotive harness are connected to the terminals of the bulb by inserting the connector plug 2 into the receptacle. Sealing rings are provided on the forward cylindrical portion 10 and sealing means are also provided between the connector plug 2 and the receptacle 12 as will be described below.

Figure 2:
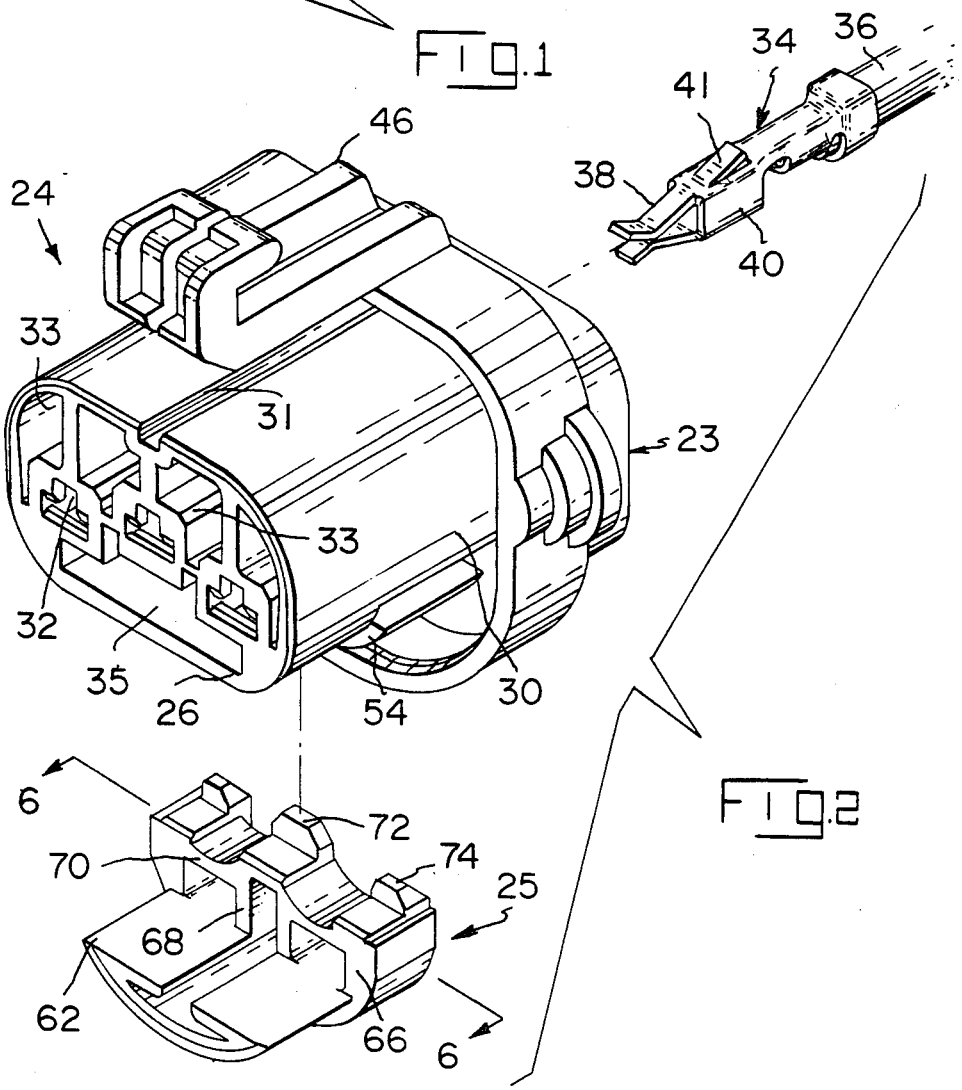
FIG. 2 is a perspective view of a connector plug with the connector retainer and one of the terminals exploded from the main body part of the plug housing.
Figure 4:
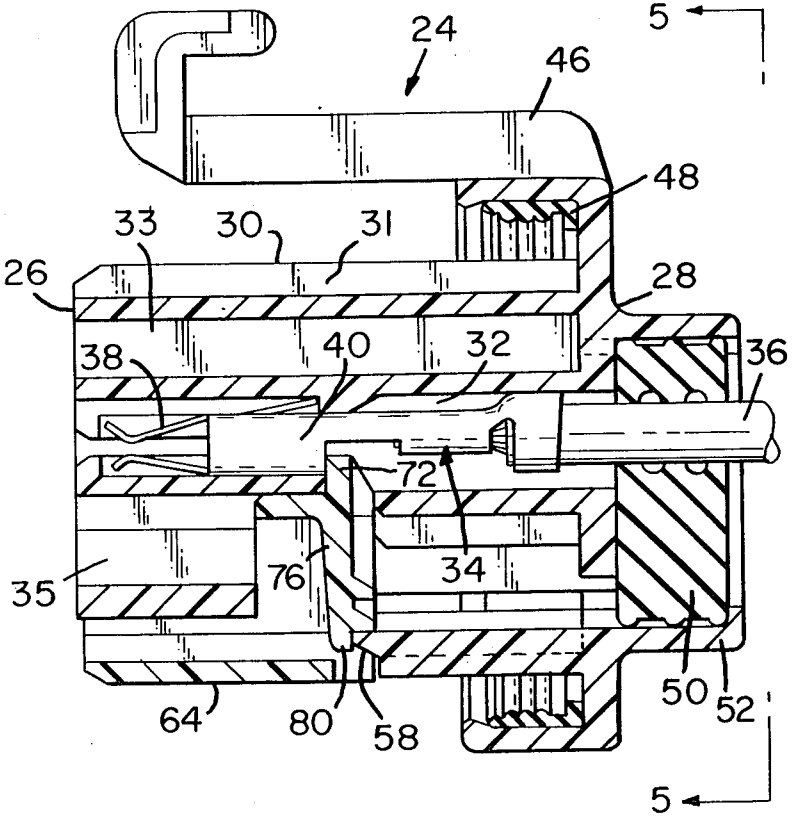
FIG. 4 is a view similar to FIG. 3 but showing the parts assembled to each other.

The connector 2, FIGS. 2–4, comprises an insulating housing 24 which in turn comprises a main housing body part 23 and a terminal retainer part 25. The housing assembly 24 has a mating end 26, a wire entry end 28, and a cylindrical external surface 30 which extends between the two ends. The cylindrical surface is not a right circular cylinder but is somewhat irregular as shown and an axially extending slot 31 is provided which is intended to receive a rib on the internal surface of the receptacle 12.

Contact-receiving cavities 32 extend through the main housing body part 23 and a contact terminal 34 is contained in each of these cavities. The terminals are crimped onto wires 36 and each terminal has a forward spring contact end 38 which is located adjacent to the mating end 26 of the housing. An intermediate box-like section 40 is provided which is engaged by the retaining ears of the terminal retainer as described below. A retaining lance 41 is provided on the box-like section 40 which bears against a shoulder in the cavity, see FIG. 3. The retainer 25 provides a more positive and sturdy retaining ear for each terminal and thereby improves the reliability of the connector.

It should be mentioned that openings other than the contact-receiving cavities 32 are provided in the main body part of the housing as shown at 33 and 35. The openings 33 are provided primarily to reduce the amount of plastic material in the housing body part and accelerate solidification of the molding material at the time of manufacture. The opening 35 serves a similar function and also permits the placement of core pins which are required to produce various internal shoulders and an opening 60 in the housing.

A flange 42 extends radially from the surface 30 at the rearward end of the main body part and this flange has a forwardly extending continuous lip 44. The flange 42 and lip 44 define a pocket within which there is contained a sealing gasket 48 so that when the parts are coupled to each other, a peripheral seal will be provided. The latch arm 46 is a split arm which cooperates with the latching ear 22 on the receptacle 12 extends from the surface of the lip 44. This latch arm 46 and the latching ear 22 are in the disclosed embodiment of the general type described in U.S. Pat. No. 4,026,624.

It is desirable to provide a seal around each of the wires 36 and to accomplish such a seal, an integral confining wall 52 extends from the wire entry end of the housing. The sealing gasket 50 for the wires is contained in the enclosure defined by this confining wall and has openings through which the individual wires extend.

The contact retainer part 25 is received in a retainer-receiving recess 54 which extends into the main body part from the lower surface thereof as viewed in FIG. 3. The recess 54 intersects the recess 35 and extends to the individual contact-receiving cavities 32. The lower portion of the main body part forwardly of the recess 54 has a flat surface 56 and the contact retainer has a base portion 62 which bears against this surface as will be described below. A tooth 58 is provided on the main body part adjacent to the recess 54 and cooperates with the retainer part as will also be described below. An access opening 60 for permitting access to the arm of the main body part or the retainer part is provided in the wire entry end 28 so that a tool can be inserted through the opening 60 to disengage the latching system by which the retainer is held in the main body.

Figure 7:
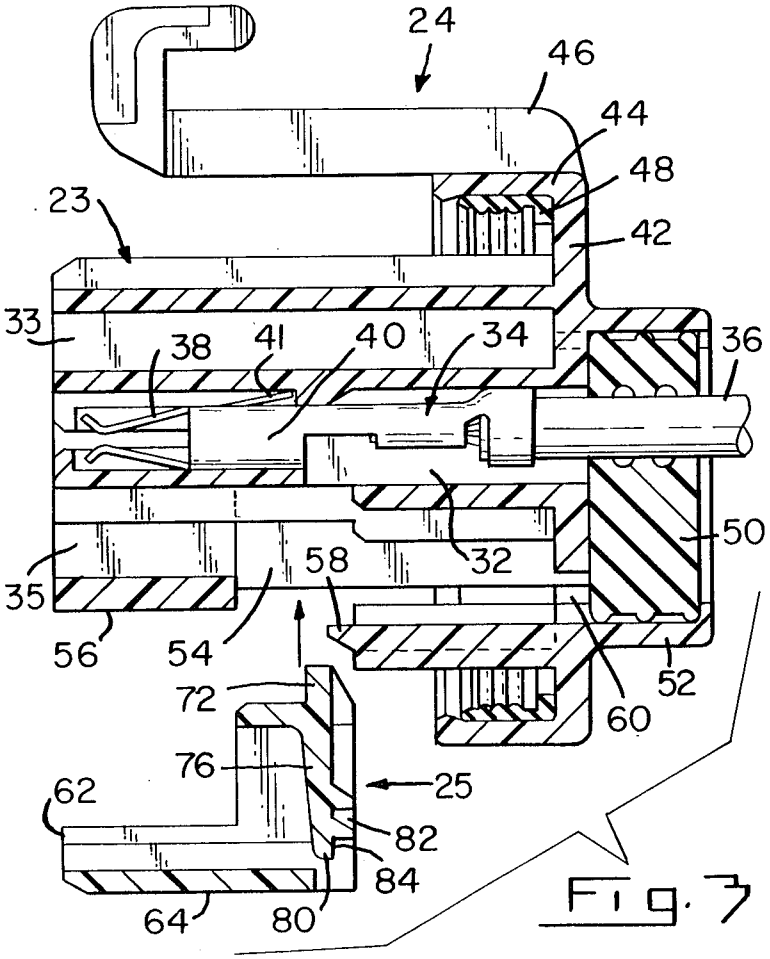
Figure 5:
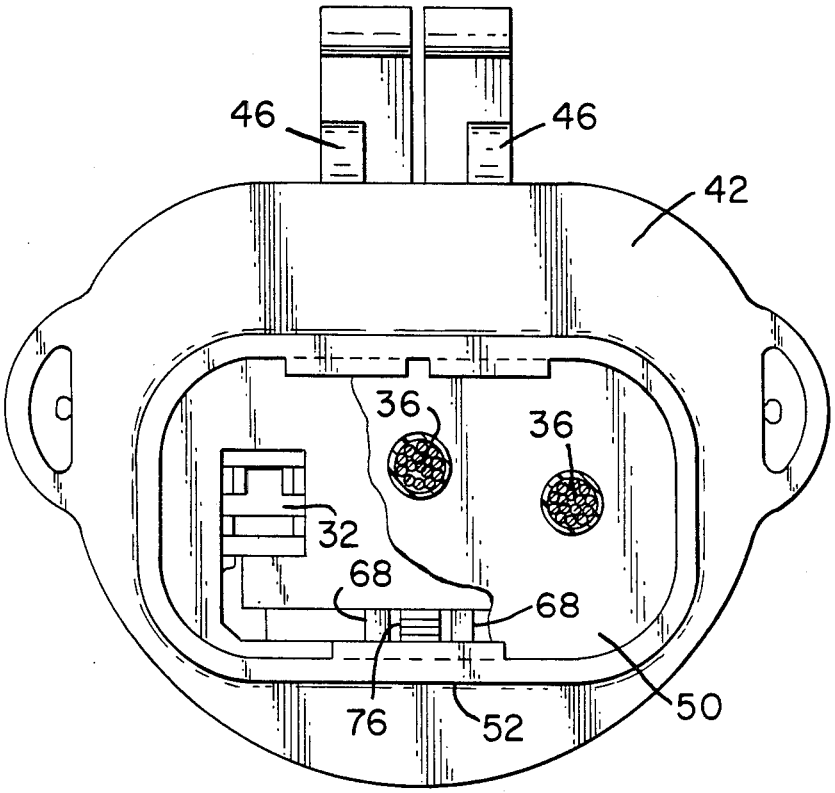
FIG. 5 is a view of the wire entry end of the plug housing looking in the direction of the arrows 5—5 of FIG. 4, some parts being broken away.
Figure 6:
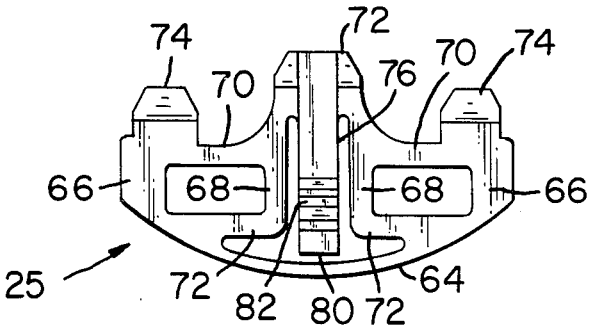
FIG. 6 is a view looking in the direction of the arrows 6—6 of FIG. 2 showing the terminal retainer part.

Referring now to FIGS. 3 and 6, the terminal retainer part 25 comprises the base 62 which has a segmental cylindrical surface 64 and a support structure that extends from this base and has terminal-retaining ears 72, 74 thereon. The support structure comprises outer supports 66 and inner spaced apart supports 68 which are connected to the outer supports 66 by horizontal connecting members 70, 72. The outer retaining ears 74 extend above the outer support 66 while the central terminal retaining ear 72 is supported by the horizontal supports 70 shown in FIG. 7. When the terminal retainer is inserted into the terminal retaining recess, these ears 72, 74 project into the terminal-receiving cavities and are located behind the rectangular box-like section of each terminal so that the terminals cannot be removed from the cavities.

The releasable latching system for latching the terminal retainer to the main body part comprises the previously identified ear 58 and a latch arm 76 which is integral with the support structure adjacent to the central retaining ear 72 and which has a free end 80. The free end is proximate to the outer surface 64 of the retainer and is in alignment with the access opening 60 when the retainer is fully inserted into the recess 54 so that a tool can be inserted through the opening 60 and pushed against the free end of the latch arm to disengage the latch arm from the tooth 58.

The latch arm has a recess 82 that is spaced from its free end and which is dimensioned to receive the tooth 58. This recess is provided in order to permit assembly of the retainer to the main body part in a partially inserted condition. When the terminals are assembled to the connector plug, the terminals are inserted into the terminal-receiving cavities while the retainer is in its partially inserted position. Thereafter, the retainer is pushed inwardly until the tooth 58 enters a recess 84 at the free end of the latch. The fact that the retainer is fully inserted is immediately apparent to the technician carrying out the assembly operation for the reason that the surface 64 of the retainer will then be flush with the cylindrical surface 30 of the main body part.

It will be apparent from the foregoing that a connector plug in accordance with the invention is of minimum length as measured between the wire entry and the mating end 26; the length is only slightly greater than the overall length of the terminals and when the plug is coupled to the receptacle 12, only a minor portion of the plug projects beyond the open end 20 of the receptacle. Notwithstanding the compact dimensions of the receptacle, effective sealing is provided between the wires and the housing by virtue of the wire sealing gasket 50 and a continuous peripheral seal is provided b virtue of the presence of the peripheral seal 48. Furthermore, the plug is fully serviceable in that the terminals can be removed by merely disengaging the latch arm from the tooth 58, removing the retainer from the recess 54, and thereafter pulling the terminals from the cavities in the housing. The fact that the retainer is surrounded by the internal surface of the receptacle 12 when the plug is coupled to the receptacle provides assurance that the retainer will not become loose and the terminals will thereby be retained in the cavities. The fact that the terminal retainer 25 is located between the mating end 26 and the wire entry end contributes to the sealing in that the terminal retainer does not interfere with the wire sealing gasket 50 or the peripheral gasket 48. In some connectors having terminal retainers, the retainer is located at the wire entry end and it would therefore interfere with the sealing gaskets.

We claim:

1. An electrical connector plug which is intended to be coupled to a complementary connector, the complementary connector comprising a hollow cylindrical receptacle having an open plug-receiving end, an inner end, and a plurality of terminals extending from the inner end parallel to the axis of the receptacle, the connector plug comprising a cylindrical housing having a mating end and a wire entry end, a plurality of terminal-receiving cavities extending through the housing from the wire entry end to the mating end, a terminal retained in each of the cavities by a terminal retainer, the cylindrical housing having an external cylindrical surface which is substantially against the internal surface of the hollow cylindrical receptacle when the connector plug is inserted into the cylindrical receptacle, the connector plug being characterized in that:

the cylindrical housing comprises a separate main body part and a separate terminal retainer part, the terminal-receiving cavities extending through the main body part, a retainer-receiving recess extends into the main body part at a location between the mating end and the wire entry end, the recess extending transversely of the axis of the housing to, and intersecting, the terminal-receiving cavities, the retainer part being inserted into the recess and having terminal retaining ears which project into the terminal-receiving cavities, the ears preventing axial movement of the terminals in at least one direction whereby the terminals are retained in the cavities, the retainer part and the main body part having a releasable latching system for securing the retainer part in the body part, the latching system comprising a flexible latch arm on one of the parts and a latching ear on the other part, the latching system being entirely contained within the housing and surrounded by the external cylindrical surface, and an access opening extending into the housing to the latching system to permit access to the latching system so that the retainer part can be unlatched from the main body part and removed therefrom.

2. An electrical connector as set forth in claim 1 characterized in that the latch arm is on the retainer part and the latch ear in on the main body part.

3. An electrical connector as set forth in either of claims 1 or 2 characterized in that the access opening extends from one of the ends of the housing to the retainer-receiving recess.

4. An electrical connector as set forth in claim 3 characterized in that the access opening extends from the wire entry end of the housing to the retainer-receiving recess.

5. An electrical connector plug as set forth in claim 3 characterized in that the retainer part comprises a base having a segmental cylindrical surface which forms part of the external cylindrical surface of the housing when the retainer part is inserted into the retainer-receiving recess, the terminal retaining ears extending from the base.

6. An electrical connector plug as set forth in claim 2 characterized in that the access opening extends from the wire entry end of the housing to the retainer-receiving recess, the retainer part comprising a base having a segmental cylindrical surface which forms part of the external cylindrical surface of the housing, the terminal retaining ears extending from the base, the latch arm extending from one of the terminal retaining ears.

7. An electrical connector plug as set forth in claim 1 characterized in that the latching system comprises a flexible latch arm on the retainer part and a latching ear on the main body part, the access opening extending from one of the ends of the housing to the retainer-receiving recess, the retainer part comprising a base having a segmental cylindrical surface which forms part of the cylindrical surface of the housing, the latch arm and the terminal retaining ears being supported on the base.

8. An electrical connector plug as set forth in claim 7 characterized in that the latch arm comprises a cantilever having a fixed end which is spaced inwardly from the cylindrical surface of the housing and a free end which is proximate to the cylindrical surface, the access opening being in alignment with the free end of the latch arm.

9. An electrical connector plug as set forth in claim 8 characterized in that the base of the retainer part extends from the retainer-receiving opening to the mating end of the housing.

10. An electrical connector plug as set forth in either of claims 1 or 9 characterized in that the housing has a circumferential sealing gasket around the external cylindrical surface thereof at a location proximate to the wire entry end of the housing.

11. An electrical connector plug as set forth in claim 9 characterized in that the housing has an integral gasket support extending around the cylindrical surface thereof proximate to the wire entry face and a sealing gasket in the gasket support.

* * * * *